United States Patent [19]

Gibbs

[11] Patent Number: 4,490,094

[45] Date of Patent: Dec. 25, 1984

[54] METHOD FOR MONITORING AN OIL WELL PUMPING UNIT

[76] Inventor: Sam G. Gibbs, 2064 Market St., Midland, Tex. 79703

[21] Appl. No.: 388,677

[22] Filed: Jun. 15, 1982

[51] Int. Cl.[3] ..... F04B 49/00

[52] U.S. Cl. ..... 417/42; 417/53

[58] Field of Search ..... 417/53, 42, 22–24

[56] References Cited

U.S. PATENT DOCUMENTS

| | | | |
|---|---|---|---|
| 2,941,120 | 6/1960 | Harman et al. | 417/42 |
| 3,572,959 | 3/1971 | Shaughnessy | 417/22 X |
| 3,998,568 | 12/1976 | Hynd | 417/53 X |
| 4,145,161 | 3/1979 | Skinner | 417/53 X |
| 4,302,157 | 11/1981 | Welton et al. | 417/53 |
| 4,384,825 | 5/1983 | Thomas et al. | 417/42 X |

*Primary Examiner*—Edward K. Look

*Attorney, Agent, or Firm*—Tim L. Burgess

[57] ABSTRACT

Instantaneous speeds of revolution for a beam pumping unit prime mover rotor, determined for all or a predetermined part of the pumping unit reciprocation cycle, are applied to compute one or more parameters of pumping unit performance, which are compared to predetermined values for such parameters to detect the existance of cause (such as pump-off, mechanical malfunction, electrical operating inefficiency or pumping unit imbalance) for correction of pumping unit operation, which is done if indicated by the comparison.

29 Claims, 4 Drawing Figures

40
42
P
P
P
P
41
INPUT
OUTPUT
36a
36b
XPCR SIGNAL
49
INTERFACE
OUTPUT TO EXTERNAL COMPUTER
45
OUTPUT RELAY
47
46
OUTPUT RELAY
48
CONTROL TO MOTOR BOX
62
63
43
INPUT
OUTPUT
44
MODE SELECT TOGGLE SWITCHES
60b
60a
51
SET / RESET COUNTER DIVIDER
69
68
RAM
53
65
EPROM
55
RAM
52
64
EPROM
54
50
61
66
QUARTZ CLOCK
TIME REFERENCE
56
C.P.U
67
57
POWER SURGE AND INTERFERENCE RESET
TO ALL SECTIONS
58
SYSTEM POWER SUPPLY
FROM CONTROL BOX POWER

METHOD FOR MONITORING AN OIL WELL PUMPING UNIT

BACKGROUND OF THE INVENTION

This invention relates to methods for monitoring an artificial lift oil well produced by sucker rod pumping, and more particularly, to pump-off controllers.

Most artificial lift wells are produced by sucker rod pumping, most commonly with a beam pumping system. In these systems, a surface prime mover acting through a gear reducer powers reciprocation of a sucker rod string. The sucker rod string is attached to a subsurface plunger that reciprocates within a working barrel which either is integrally connected to the bottom of the well tubing or is integrally part of a subsurface pump assembly packed off against the tubing (or casing where tubing is not installed). The plunger has an aperture that is opened and closed by a "traveling" valve. In the clearance space below the bottom reach of the plunger, the head of the working barrel has an intake aperture that is opened and closed by a "standing" valve. In general, the column of oil fluids in the tubing (or casing) is supported by the working barrel head when the traveling valve is opened and the standing valve is closed, and by the rod string and plunger when the traveling valve is closed.

In an ordinary pump, at the start of the rod-drawn plunger upstroke the traveling valve closes, and the fluid column load is picked up by the rods. As the plunger moves up, flued in the pump chamber clearance space expands and pressure within the chamber decreases to the pump intake pressure at which the standing valve opens, whereupon fluid from the producing zone enters the pump chamber. As the rods and plunger continue their upstroke, the fluid column above the plunger is lifted essentially by the distance of upstroke travel, and a displaced volume of fluid essentially equal to the swept volume of the plunger in the working barrel is collected at the surface. During this upstroke, the pump chamber fills with producing zone fluids. On reaching the top of the upstroke and starting the downstroke, the standing valve closes and the traveling valve, under the weight of the undisplaced fluid column, remains closed. Gas (if present) in the pump chamber is compressed until pressure in the chamber increases to the pump discharge pressure at which the traveling valve opens, and fluid load is transferred from the rods to the tubing. As the rods and plunger continue their downstroke, fluids within the chamber are displaced up through the traveling valve aperture into the tubing.

If the producing zone pressure is insufficient to cause complete liquid fillage of the pump chamber during the upstroke of the plunger, the traveling valve does not open on the ensuing downstroke until the plunger approaches and encounters the relatively incompressible liquid in the chamber. The resulting "impact" between the plunger and the liquid produces an upward force, and the "load" on the plunger is released suddenly. This causes a pounding, called "fluid pound", that can be damaging to the rod string, the pump assembly and the surface pumping unit. When this condition of incomplete pump chamber fillage happens, the well is said to "pump off". Aside from possible damage caused by fluid pound, operating a pumping unit when incomplete pump chamber fillage is occurring is wasteful of power relative to fluids produced, since volumetric efficiency of the pump is lower.

Devices called pump-off controllers have been developed to sense when pump-off occurs, so that the surface pumping unit can be shut down to reduce possible mechanical damage to the equipment and eliminate wasteful use of power. After a preset period of shut off, the pumping unit is then restarted. Many pump-off controllers are equipped with a mechanical malfunction shut down feature used to detect parted rods and inoperative pumps. Run time totalizers may also be employed, to indicate a worn pump or tubing leaks, or changes in well conditions such as well decline and water flood response.

Pump-off controllers generally are of two types, local logic and central computer control. The local logic type is a self contained system mounted at the pumping unit. Investment cost is comparatively low, but the system must be monitored and adjusted manually at the well site. Central computer control involves sensors installed on the pumping equipment. Data from the sensors are transmitted by cable or other telemetry to a central computer for well monitoring and control. Investment cost is relatively high, but the system has the advantage of being able to monitor wells at a central point to minimize down time caused by malfunctions.

Pump-off controllers differ in the methods or techniques of sensing pump-off. The more widely used methods of sensing pump-off are: polished rod load, motor current, vibration, flow/no flow, and bottom hole producing pressure.

Currently the most common method of sensing pump-off is monitoring polished rod load. Polished rod load monitoring techniques can be broken down into three categories: rod work, rate of change of load on the downstroke, and rod load at a particular polished rod position on the downstroke. My invention disclosed in U.S. Pat. No. 3,951,209 measures polished rod load and displacement and integrates these measures numerically to obtain power input to the polished rod and rod string at the surface. Because the power required at the downhole pump decreases when the well pumps off, pump-off is indicated by a reduction in the power input to the rod string at the surface.

Rate of change of load on the downstroke can usually be used to detect pump-off, because a fluid pound is often associated with a rapid load change on the downstroke. However, a fluid pound at the pump is not always clearly defined at the surface because of rod stretch and dynamics, and these conditions can make the load rate of change concept less sensitive to pump-off.

Another variation uses rod load to a position in the upper portion of the downstroke. This is sampled under a filling condition and is used as a reference. When a fluid pound occurs, rod load departs from the reference load and pump-off is sensed. An example is U.S. Pat. No. 4,286,925. This method of detecting pump-off is difficult to adjust and maintain, and a position marker switch must be used.

Controllers which use polished rod monitoring techniques require position and/or load transducers and, where digital computers are involved, associated analog to digital converters.

Motor current is widely used to sense changes in polished rod loads and changes in polished rod work, hence pump-off, since the product of the current and voltage is roughly proportional to polished rod work and voltage is nearly constant. As pump fillage changes from complete to partial, the upstroke current peak changes only slightly; however the downstroke current peak can change appreciably. This is because the fluid load remains on the rods during the downstroke until the traveling valve is opened. As a result the unit often becomes more rod heavy when pump fillage is reduced. The rod heavy condition causes the upstroke current peak to change relative to the downstroke current peak.

Examples of patents involving a motor current method for detecting pump-off are U.S. Pat. Nos. 3,363,573; 3,953,777 and 3,998,568. In practice, the most widely used techniques employ motor current averaging. When a well is pumped off and pounding, less current is required by the electric motor and consequently the average current for the stroke reciprocation cycle is less than when complete pump fillage is occurring; thus a decrease in average current levels is used to sense pump-off. However, available controllers which use the motor current averaging method do not adequately differentiate between generating currents and motoring currents. As may be seen by reference to the current curve illustrated in FIG. 1, it is seen that motor current decreases with increasing speeds of revolution of the motor until the synchronous speed of the motor is reached; at speeds greater than the synchronous speed, motor current increases. The motor's operating current in the rotational speed range from starting to synchronous speed is known as the motoring current, and the operating current in the speed range which is greater than the synchronous speed is known as the generating current. Since current increases when synchronous speed is exceeded, but also as the motor labors harder below synchronous speed, motor load cannot be simply related to average motor current, and this is believed to be a major cause of unsatisfactory performance of these pump-off controllers.

Other techniques using motor current sense a difference in motor current peaks or sense current at a point on the downstroke. To use a difference in current peaks, the controller requires the unit to be in balance or slightly rod heavy, otherwise the controller logic can be confused. Using current at a point on the downstroke is difficult to calibrate and to maintain in adjustment, and requires a position marker.

The vibration method of sensing pump-off operates on the principle that a shock load or vibration is usually associated with a fluid pound. A sensor is installed on the unit structure, normally the walking beam. When the load or vibration increases in magnitude to the shock load setting of the sensor, fluid pound is sensed and the unit is shut down. Examples of this method are U.S. Pat. Nos. 2,661,697 and 3,851,995. However, a fluid pound at the pump is not always evident at the surface, especially in deep wells that are operating at a slow pumping speed, and under these conditions, the vibration sensing method is not especially effective.

In the flow/no flow method, a flow rate sensor is placed in the flow line. When the well pumps off, the producing rate is reduced. The sensor is calibrated to sense the reduction in pumping rate over a preselected period of time. If the rate is below a preset threshold, pump-off is determined and the unit is shut down. Examples of a flow/no flow method are U.S. Pat. Nos. 2,550,093; 2,697,984; and 3,105,443. In general, the flow/no flow method is difficult to adjust and can be confused by well heading.

In the bottom hole producing pressure method, a pressure sensor is used to measure the bottom hole producing pressure. Pressure data are transmitted by electric cable to the surface controller. When the producing pressure is reduced to a preset amount, the unit is shut down and restarted after an adjustable time delay. This is a good method of controlling pump-off, but has the disadvantage of high initial costs and high maintenance costs. Problems associated with the data transmission cable are common.

THE INVENTION

My present invention is useful for but not limited to pump-off control. In my present invention, I depart from prior techniques for sensing pump-off and, instead monitor, for correction, the operation of an oil well pumping unit by determining instantaneous speeds of revolution of the prime mover rotor during the period of a complete or predetermined portion of the reciprocation cycle, and, applying all or selected such speeds, determining at least one parameter of pumping unit performance for such period that is a function of such instantaneous speeds. That parameter so determined is compared to a predetermined value of the same parameter to detect whether cause exists for correcting operation of the oil well pumping unit. When cause is indicated by that comparison, pumping unit operation is corrected.

Parameters of pumping unit performance for the period of a reciprocation cycle or predetermined part thereof which are a function of instantaneous speeds of prime mover rotor rotation, and are determined in accordance with my invention, are prime mover power output, prime mover modified average current, prime mover power input, prive mover thermal current, prime mover power factor, power transmission unit maximum torque, and total polished rod work (all as hereinafter defined). Thus, in one aspect of my invention, the performance parameter determined for the said period is one or more of prime mover power output, prime mover modified average current, or total polished rod work, and the said same predetermined value respectively may be a value of prime mover power output, prime mover modified average current or total polished rod work, when the said well pump is completely filled with fluid. Where the comparison indicates the determined selected performance parameter bears a predetermined relationship to that corresponding full-fillage value, cause is indicated for correcting operation of the pumping unit, such as stopping reciprocation when the well is pumped-off and pounding or has suffered a mechanical malfunction. Alternatively, the said same predetermined value may be a value relative to the full fillage value which, when reached by the determined selected performance parameter, indicates cause for a corrective operation, such as slowing or stopping reciprocation.

Accordingly, the method of my invention is useful for pump-off control. The power output of a prime mover is used to overcome power losses in the surface pumping unit drive train and to provide polished rod power for lifting oil and water in the well tubing above the rod-drawn pump plunger. Thus, when a well pumps off, polished rod power requirement decreases and a related decrease in motor power output occurs. Similarly, when a mechanical malfunction such as a rod parting happens, a sudden drop in motor power output occurs because oil and water are no longer being lifted.

By determining prime mover instantaneous speeds of revolution during a reciprocation cycle and using those speeds to determine the power output of the prime mover during that reciprocation cycle, then comparing the determined power output value to a power output value indictive of pump-off or mechanical malfunction, the motor can be de-energized to stop reciprocation when so indicated.

Prime mover modified average current may be similarly determined and used for detection of pump-off or other well conditions requiring correction of pumping unit operation. As explained earlier herein, less current is required by the motor when the well is pumped off, but prior current-averaging techniques have not taken into account the motor current increase in the generating region, where the motor frequently finds itself because of out-of-balance conditions when pump-off occurs. The prime mover modified average current determination employed in my invention eliminates inclusion of this "bogus" current and provides a more reliable indication of pump-off or mechanical malfunction.

Pump-off or mechanical malfunction sensing and control by my present invention, in its aspect of determining instantaneous motor speeds of revolution and with them computing total polished rod work for comparison to a reference value therefor, eliminates the need for the direct measurement load and position transducer equipment entailed in my earlier invention disclosed in U.S. Pat. No. 3,951,209.

The prime mover performance parameters of thermal current, power input and power factor, relevant where the prime mover is an electric motor, are useful for monitoring respectively electric load on the motor, the power draw of the motor (which is the principle component comprising the electrical power bill of an oil well pumping unit), and the electrical efficiency of a pumping unit installation. By determining one or more of these performance parameters in every complete or predetermined portion of a reciprocation cycle and comparing them to predetermined values therefor indicative of cause for correcting operation, appropriate corrective action can be taken when so indicated, for example, by changing the pumping unit duty cycles to different times of the day or night to achieve better electric cost efficiency or by changing the size of the motor.

In another aspect, the selected performance parameter is power transmission unit maximum torque, the predetermined value used in the comparison step is power transmission unit maximum torque on either the upstroke or downstroke portion of a reciprocation cycle, and determination of power transmission unit maximum torque is made for the other upstroke or downstroke portion of a reciprocation cycle than the stroke portion with respect to which the predetermined value was set. For example, if the predetermined value is power transmission unit maximum torque on the upstroke portion of the reciprocation cycle the determination of power transmission unit torque is made on the downstroke portion of a reciprocation cycle, preferably, as will be explained in greater detail hereinafter, on the downstroke of the same reciprocation cycle. If the comparison of these determined and predetermined values shows them to be unequal, the pumping unit is indicated to be out-of-balance, and the out-of-balance operation is corrected.

Accordingly, the method of my invention permits determination of parameters of pumping unit performance useful in monitoring operation of an oil well pumping unit to detect not only pump-off and mechanical malfunction, but also electrical operating efficiency or inefficiency and pumping unit imbalance.

More specifically, in my invention instantaneous speeds of revolution for prime mover rotor revolutions turned during a complete or predetermined portion of a reciprocation cycle of the pumping unit are determined, directly or indirectly, and all or selected of these instantaneous speeds of revolution are applied, in one feature, to obtain the value of at least one parameter of prime mover performance for the period of a complete reciprocation cycle or a predetermined portion of a cycle, as the case may be, that parameter being selected from the parameters:

prime mover power output ("PO")
prime mover modified average current ("MAC")
prime mover power input ("PI")
prime mover thermal current ("TC")
prime mover power factor ("PF").

These parameters of prime mover performance for the said period relate to the applied instantaneous speeds of motor revolution according to the following equations, in which the subscript "i" designates a prime mover rotor revolution occurring during the said period with respect to which an instantaneous speed of revolution is applied (an "ith revolution"):

$$(1)\ PO = \frac{1}{n}\sum_{i=1}^{n} P_i$$

wherein

| | | |
|---|---|---|
| PO | = | value of prime mover power output for the said period, |
| n | = | the number of all ith revolutions occurring in the said period, |
| $P_i$ | = | $\alpha T_i(RPM_i)$ |

wherein

| | | |
|---|---|---|
| $P_i$ | = | the instantaneous power output value of the prime mover on an ith revolution of the prime mover rotor, |
| $\alpha$ | = | predetermined conversion factor constant to obtain proper power units, |
| $RPM_i$ | = | the value of the instantaneous speed of prime mover rotor revolution on an ith revolution, |
| $T_i$ | = | the predetermined value of prime mover rotor instantaneous torque that corresponds to $RPM_i$ on an ith revolution of the prime mover rotor, |

$$(2)\ MAC = \frac{1}{n}\sum_{i=1}^{n} A_iC_i$$

where

| | | |
|---|---|---|
| MAC | = | value of prime mover modified average current for the said period, |
| n | = | the number of all ith revolutions occurring in the said period, |
| $C_i$ | = | the predetermined value of prime mover instantaneous current that corresponds to $RPM_i$ (as $RPM_i$ is defined for the equation (1) hereof) on an ith revolution of the prime mover rotor, |
| $A_i$ | = | 1 where $RPM_i$ on an ith revolution is less than or equal to synchronous speed of the prime mover rotor, |

-continued

| | | |
|---|---|---|
| $A_i$ | = | −1 where $RPM_i$ on an ith revolution is greater than synchronous speed of the prime mover rotor; |

$$(3)\ PI = \frac{1}{n}\sum_{i=1}^{n}\frac{P_i}{E_i}$$

where

| | | |
|---|---|---|
| PI | = | value of prime mover power input for the said period, |
| n | = | the number of all ith revolutions occurring in the said period, |
| $P_i$ | = | $\alpha T_i(RPM_i)$, |

where $P_i$, $\alpha$, $T_i$ and $RPM_i$ are the values defined for equation (1) hereof, and

| | | |
|---|---|---|
| $E_i$ | = | the predetermined value of prime mover instantaneous efficiency that corresponds to $RPM_i$ on an ith revolution of the prime mover rotor, |

$$(4)\ TC = \sum_{i=1}^{n}\sqrt{\frac{C_i^2}{n}}$$

where

| | | |
|---|---|---|
| TC | = | value of prime mover thermal current for the said period, |
| n | = | the number of all ith revolutions occurring in the said period, |
| $C_i$ | = | the value defined for equation (2) hereof, |

$$(5)\ PF = \frac{v}{n\sqrt{3}\ V}\sum_{i=1}^{n}\frac{P_i}{E_iC_i}$$

where PF is the value of prime mover power factor for the said period, v is a predetermined conversion factor to obtain proper power factor units, n is the number of all ith revolutions occurring in the said period, $P_i$ is as defined for equation (1), $C_i$ is as defined for equation (2), and V is value of voltage of the for the prime mover energizing circuit.

As respects determination of a selected parameter or parameters of pumping unit performance during a complete or predetermined portion of a reciprocation cycle, application of instantaneous prime mover rotor speeds of revolution ($RPM_i$'s) suitably involves use of a computing system which is provided, as in programmed non-volatile memory, with at least one set of predetermined values selected from value sets which are indicative of instantaneous prime mover performance characteristic values that are a function of $RPM_i$ and/or which are derived from these instantaneous performance characteristic values. These instantaneous performance characteristics are instantaneous motor torque ("$T_i$"), instantaneous motor current ("$C_i$") and instantaneous motor efficiency ("$E_i$"). The value sets derived from these $T_i$, $C_i$ and $E_i$ values are "$P_i$", "$P_i/E_i$" and "$P_i/E_i C_i$" as these are defined respectively for equations (1), (3) and (5) hereinabove. As may be seen by reference to FIG. 1, with an electric motor, motor torque, motor current and motor efficiency vary with the speed of the motor, i.e., for every motor speed abscissa value along the X-axis, there is a corresponding Y-axis ordinate value of motor torque, motor current and motor efficiency. The value sets for $T_i$, $C_i$, and $E_i$ which correspond to $RPM_i$ of the prime mover rotor are described by such motor performance curves. (FIG. 1 will be understood merely to be illustrative generally.) With an internal combustion engine or motor, motor torque will also vary with motor speed, but according to a curve characteristic of that motor.

More specifically in respect to the aspect of my invention in which power transmission unit maximum torque is determined for the portion (upstroke or downstroke) of the reciprocation cycle that is other than the portion (downstroke or upstroke) of a cycle (preferably the same cycle) for which the predetermined value of power transmission unit torque was determined, the method involves determining the time for and the instantaneous speed of each prime mover rotor revolution occurring during a downstroke of a reciprocation cycle of the said pumping unit; determining the time for and the instantaneous speed of each prime mover rotor revolution occurring during an upstroke of a reciprocation cycle of the said pumping unit; and than applying all times for and instantaneous speeds of revolution so determined and computing the power transmission unit torque for each prime mover rotor revolution (an "ith revolution"), according to the equation $$PTT_i = nT_i - \frac{kI}{\Delta t_i}(RPM_i - RPM_{i-1}) \qquad (6)$$

in which

| | | |
|---|---|---|
| $PTT_i$ | = | the value of power transmission unit torque during an ith revolution of the prime mover rotor, |
| $RPM_i$ | = | the value of the instantaneous speed of prime mover rotor revolution on an ith revolution, |
| $RPM_{i-1}$ | = | the value of the instantaneous speed of prime mover rotor revolution on the prime mover rotor revolution next preceding an ith revolution, |
| $\Delta t_i$ | = | the time required to execute an ith revolution, |
| $T_i$ | = | the predetermined value of prime mover rotor instantaneous torque that corresponds to $RPM_i$ on an ith revolution, |
| k | = | conversion factor constant to obtain proper torque units, |
| I | = | moment of inertia constant of the said drive train starting at the said prime mover rotor and ending at the said speed reducer of the power transmission unit, |

for i=1,2 . . . n revolutions of the prime mover rotor during the said upstroke and for i=1,2 . . . n revolutions of the prime mover rotor occurring during the said downstroke, where n signifies number of prime mover rotor revolutions.

Then from the $PTT_i$ values so computed for prime mover rotor revolutions occurring during the said upstroke, the maximum $PTT_i$ value is identified (the "upstroke PTTmax"), and from the $PTT_i$ values so computed for prime mover rotor revolutions occurring during the said downstroke, the maximum $PTT_i$ value is identified (the "downstroke PTTmax"). The upstroke PTTmax is compared with the downstroke PTTmax to detect whether the upstroke PTTmax and the downstroke PTTmax are unequal, and when they are, operational balance of the said pumping unit is corrected. Where upstroke PTTmax exceeds downstroke PTTmax in the comparison, the correction is increasing power transmission unit counterbalance. Where downstroke PTTmax exceeds upstroke PTTmax in the comparison, the correction is decreasing the counterbalance. For example, in a crankbalanced unit, counter balance is increased by shifting the power transmission unit crankshaft counterweight farther away from the crankshaft to increase counterbalance, or in an air balance unit, air pressure is increased; and counterbalance is decreased by the converse corrective operation.

Preferably the said predetermined value and the said determined value of power transmission unit maximum torque are computed for the upstroke half and downstroke half of the same reciprocation cycle, to assure that pumping conditions downhole from stroke to stroke do not change and invalidate the comparison. Under stable pumping conditions such as infrequent pump-off, the values for predetermined and determined power transmission unit maximum torque may be established for the opposite halfs of a stroke cycle in different stroke cycles, with less reliable results the farther apart the different cycles are.

In an aspect of my invention instantaneous polished rod loads are determined for use in computing total polished rod work, a paramenter of pumping unit performance which may be employed in my method. In this aspect, the time for and instantaneous speed of each prime mover rotor rotation occurring during the period of a complete reciprocation of the said pumping unit is determined, the position displacement of the polished rod corresponding to selected revolutions of the prime mover rotor occurring during that period is determined, and applying all times for and instantaneous speeds of revolution so determined the instantaneous polished rod load during each prime mover rotor revolution (an "ith revolution") occurring during said period is computed, according to the equation $$(7)\ PRL_i = \frac{{}_nT_i + m\sin(\theta_i + \beta) - RIT + AIT}{TF_i} + S$$

where

| | | |
|---|---|---|
| $PRL_i$ | = | value of instantaneous polished rod load on an ith revolution of the prime mover rotor, |
| n | = | the number of all ith revolutions occurring in the said period |
| $T_i$ | = | the predetermined value of the instantaneous motor torque that corresponds to $RPM_i$ on ith revolution |
| m | = | predetermined value for counterbalance effect |
| $\theta_i$ | = | angle of pumping unit crankshaft corresponding to the ith revolution of the prime mover rotor |
| $\beta$ | = | predetermined phase angle for counterbalance |
| $TF_i$ | = | predetermined value of instantaneous torque factor that corresponds to the ith revolution of the prime mover rotor |
| $RIT_i$ | = | rotary inertia torque effect on prime mover rotor during its ith revolution as given by |

$$RIT_i = \frac{I_r(RPM_i - RPM_{i-1})}{\Delta t_i}$$

where

| | | |
|---|---|---|
| $I_r$ | = | predetermined moment of inertia of rotary elements in said drive train |
| $RPM_i$ | = | the value of the instantaneous speed of prime mover rotor revolution on an ith revolution, |
| $RPM_{i-1}$ | = | the value of the instantaneous speed of prime mover rotor revolution on the prime mover revolution next preceding an ith revolution, |
| $\Delta t_i$ | = | the time required to execute an ith revolution |
| $AIT_i$ | = | articulating inertia affect on motor during its ith revolution as given by |

$$AIT_i = \frac{TF_i Ia}{A^2}\left[\frac{PRP_{i+1} - 2\,PRP_i + PRP_{i-1}}{\Delta t_i^2}\right]$$

where

| | | |
|---|---|---|
| $TF_i$ | = | as defined hereinabove for this equation (7) |
| $I_a$ | = | moment of inertia of said surface structure for changing rotating motion into reciprocating motion |
| n | = | as defined hereinabove for this equation (7) |
| A | = | predetermined dimension of pumping unit |
| $t_i$ | = | as defined hereinabove for this equation (7) |
| $PRP_i$ | = | position of said polished rod corresponding to ith revolution of prime mover rotor |
| $PRP_{i+1}$ | = | position of polished rod corresponding to revolution of the prime mover rotor immediately following the ith revolution |
| $PRP_{i-1}$ | = | position of polished rod corresponding to revolution of the prime mover rotor immediately preceding the ith revolution, and |
| S | = | predetermined constant for structural imbalance of the pumping unit. |

The instantaneous polish rod loads so determined may be related to polished rod position displacements determined as hereinabove described to obtain a plot of one of them against the other. This plot, it will be appreciated, is an inferred "surface card." Integrating, in respect to such plot, instantaneous polished rod load verses polished rod position displacement gives the value for total polished rod work for the reciprocation period. That value is then compared to a predetermined value for total polished rod work, to detect whether cause exists for correcting operation of said pumping unit, and when causes is thereby indicated, operation of the pumping unit is corrected. The value indicative of cause for correcting operation of said pumping unit may be determined from the inferred surface card plot.

In the foregoing compution for equation (7), the rotating and articulating inertia effects are refinements and can be neglected in many applications where $RIT_i$ and $AIT_I$ are so small as to be negligible.

In a variation of the method and the method aspects described in respect to equation (7), the same method for determining and utilizing instantaneous polished rod loads involves a different equation for instantaneous polished rod loads where the pumping unit is air balanced, such as the Lufkin Industries F-1081 Air Balanced Pumping Unit, well known in the art. The counterbalance in these units is provided by a cylinder and piston air tank connected to the walking beam. In this variation, instantaneous polished rod load during each prime mover rotor revolution (an "ith revolution") occurring during said period is computed according to the equation.

$$(8)\ PRL_i = \frac{nT_i + RIT_i - AIT_i}{TF_i} + M(PR_i - S)$$

where

| | | |
|---|---|---|
| $PRL_i$ | = | value of instantaneous polished rod load on an ith revolution of the prime mover rotor, |
| n | = | the number of all ith revolutions occurring in the said period |
| $T_i$ | = | the predetermined value of the instantaneous motor torque that corresponds to $RPM_i$ on ith revolution |
| $TF_i$ | = | predetermined value of instantaneous torque factor that corresponds to the ith revolution of the prime mover rotor |
| S | = | air pressure required to offset pumping unit structural unbalance |
| M | = | predetermined constant relating area of said piston to dimensions of said walking beam |
| $PR_i$ | = | counterbalancing air pressure corresponding to the ith revolution of the prime mover rotor. |
| $RIT_i$ | = | rotary inertia torque affect on prime mover rotor during its ith revolution as given by |

$$RIT_i \frac{I_r(RPM_i - RPM_{i-1})}{\Delta t_i}$$

where

| | | |
|---|---|---|
| $I_r$ | = | predetermined moment of inertia of rotary elements in said drive train |
| $RPM_i$ | = | the value of the instantaneous speed of prime mover rotor revolution on an ith revolution, |
| $RPM_{i-1}$ | = | the value of the instantaneous speed of prime mover rotor revolution on the prime mover revolution next preceding an ith revolution, |
| $\Delta t_i$ | = | the time required to execute an ith revolution |
| $AIT_i$ | = | articulating inertia affect on motor during its ith revolution as given by |

$$AIT_i = \frac{TF_i Ia}{A^2}\left[\frac{PRP_{i+1} - 2\,PRP_i + PRP_{i-1}}{\Delta t_i^2}\right]$$

where

| | | |
|---|---|---|
| $TF_i$ | = | as defined hereinabove in this equation (8) |
| $I_a$ | = | moment of inertia of said surface structure for changing rotating motion into reciprocating motion |
| n | = | as defined hereinabove in this equation (8) |
| A | = | predetermined dimension of pumping unit |
| $\Delta t_i$ | = | as defined hereinabove in this claim |
| $PRP_i$ | = | position of said polished rod corresponding to ith revolution of prime mover rotor |
| $PRP_{i+1}$ | = | position of polished rod corresponding to revolution of the prime mover rotor immediately following the ith revolution |
| $PRP_{1-1}$ | = | position of polished rod corresponding to revolution of the prime mover rotor immediately preceding the ith revolution. |

The foregoing summary concerning my invention and its application will be better understood from the detailed description which follows in reference to the drawings now explained.

DETAILED DESCRIPTION OF THE PREFERRED EMBODIMENTS

Figure 1:
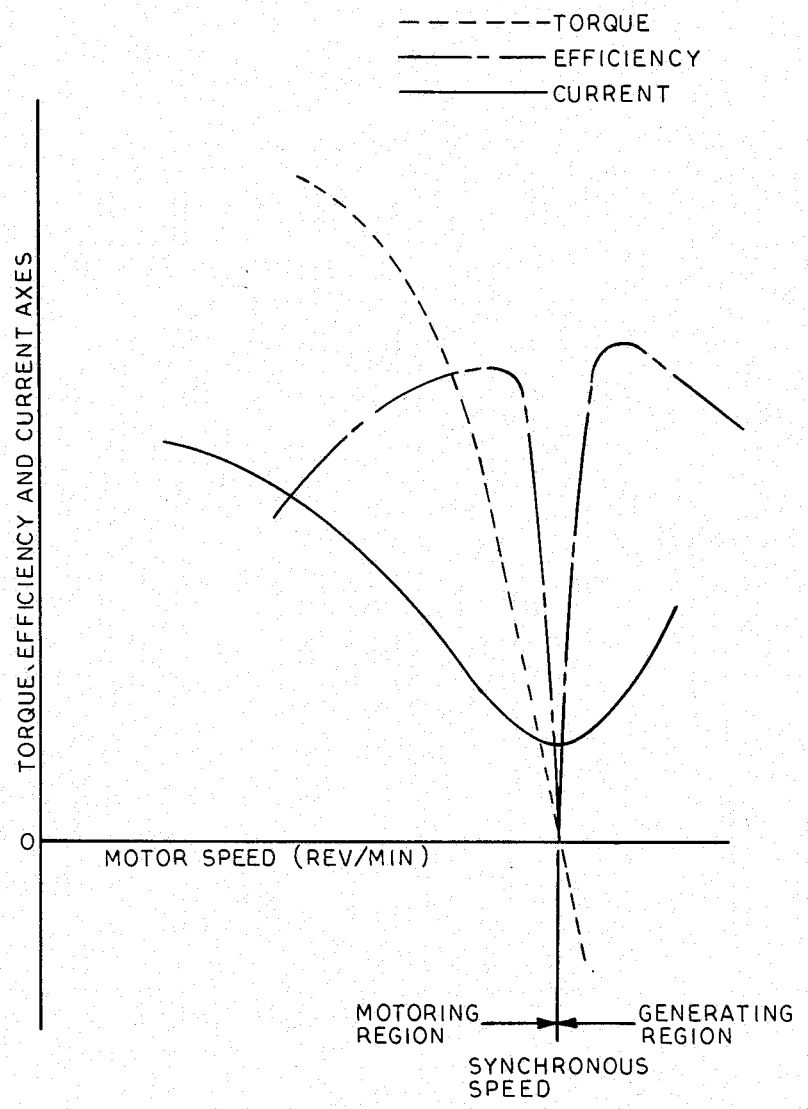
FIG. 1 illustrates general form curves of torque, current and efficiency electric motor performance characteristics as a function of motor speed.
Figure 2:
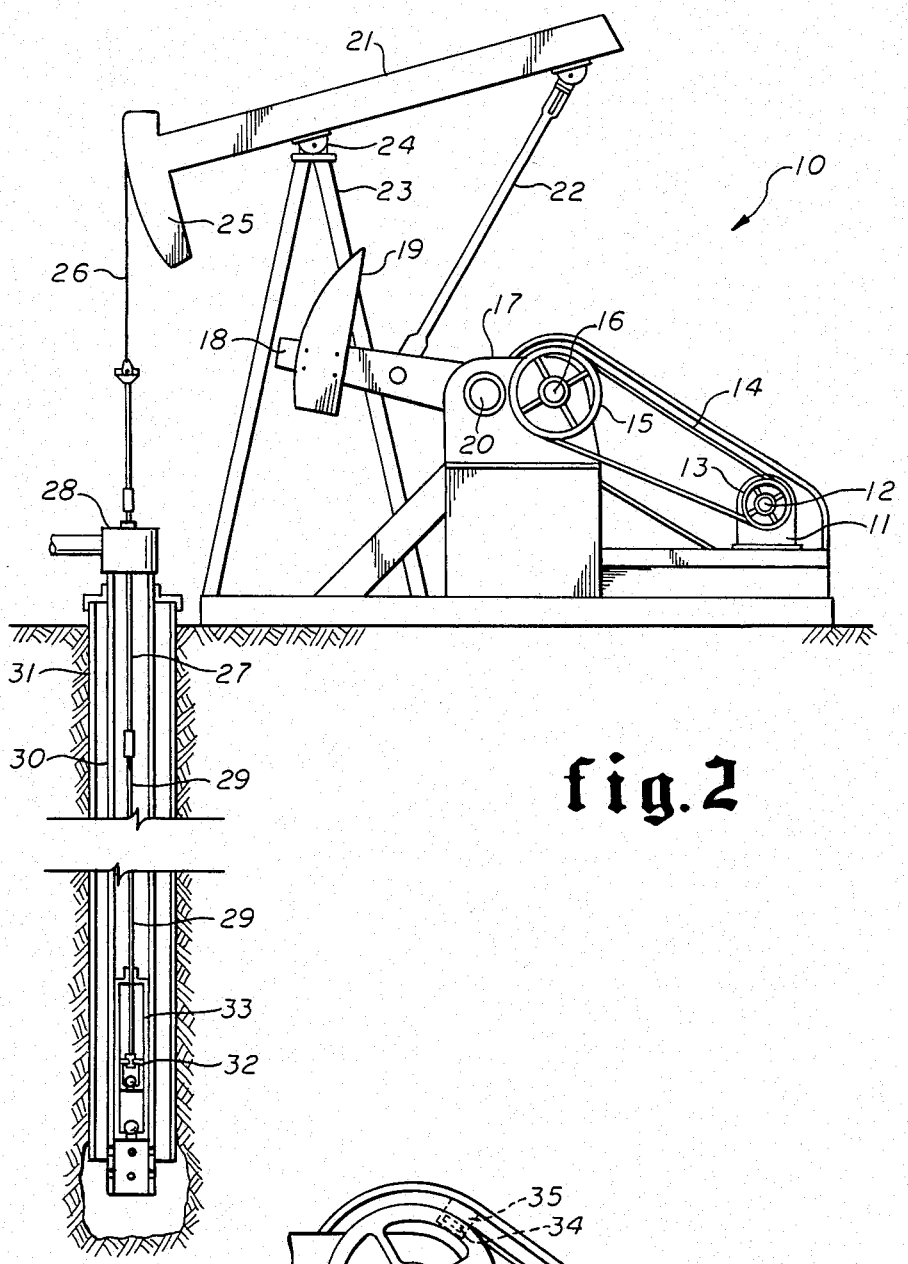
FIG. 2 illustrates in diagrammatic form an artificial lift beam-pumping system of the general type whose operation is monitored for correction by the present invention.

Referring to FIG. 2, an oil well pumping unit generally indicated by reference numeral 10 comprises a surface rotating motion, power producing prime mover 11, suitably an electric induction motor, having a motor rotor 12 to which a sheave 13 is fitted. Motor rotor 12 power output is transmitted by belt 14 to the sheave 15 of rotor 16 of power transmission or gearbox unit 17. Gearbox unit 17 reduces the rotational speed of motor rotor 12 through a slow speed reduction gear at crankshaft end 20 to which crankarm 18 is journaled and imparts rotary motion to crankarm 18 and the pumping unit counterbalance, counterweight 19. The rotary motion of crankarm 18 is converted to oscillating or reciprocating motion by means of walking beam 21. Crankarm 18 is connected to walking beam 21 by means of Pitman arm 22, and is supported by Samson post 23 and saddle bearing 24. A walking beam horsehead 25 and a bridle cable arrangement 26 hang polished rod 27 which extends through a stuffing box 28. A string of sucker rods 29 hangs from polished rod 27 within tubing 30 located in casing 31. The rod string is connected to the plunger 32 of subsurface reciprocating pump 33. In a reciprocation cycle of the structure including the walking beam, polished rod and the subsurface rod string and pump plunger, oil fluids are lifted on the upstroke, when pump fillage occurs, and on the downstroke fluids in the pump chamber are exhausted into the tubing above the plunger, as already explained. (Other types of down hole pumps can lift fluid on up and down strokes. This does not affect the applicability of this invention).

Figure 3:
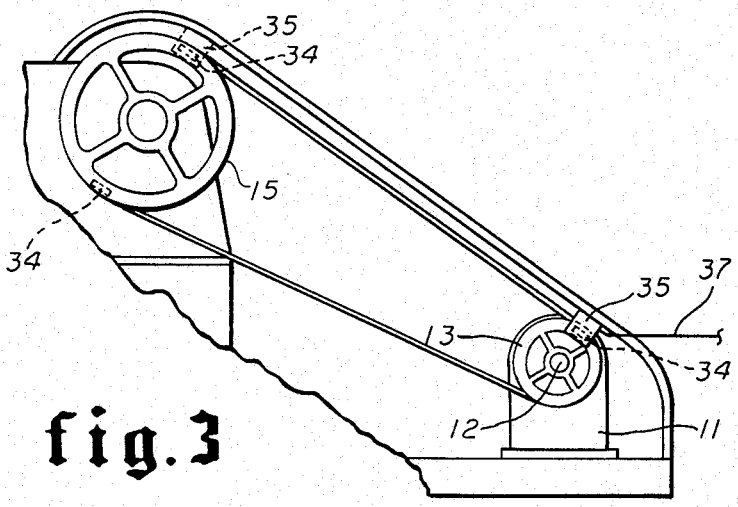
FIG. 3 illustrates means for sensing motor revolutions.

Illustrating the method of my invention first in reference to its application for pump off control of oil well pumping unit 10, means are provided by which prime mover revolutions turned during a complete or predetermined portion of the pumping unit reciprocation cycle are signified. In the embodiment illustrated in FIG. 3, a magnet 34 is affixed to motor rotor 12 (not illustrated) or motor rotor sheave 13 and an induction transducer 35 is positioned opposite a point of passage of the magnetic target 34 so that on each pass-by of the target a signal pulse **36*a*, 36*b*, . . . 36*n* is generated by the transducer and conducted by line 37, signifying a revolution of the motor rotor 12. Motor rotor sheave 13 turns a number of times for each turn of gearbox rotor sheave 15 according to the difference in diameters of these sheaves. A signal indicative of a motor rotor 12 revolution alternatively can be generated by affixing about the circumference of gearbox sheave 15 that number of magnetic targets 34 which equals the number of turns of motor sheave 13 for one turn of gearbox sheave 15 (shown in FIG. 3 by dashed lines) and by positioning an inductive transducer 35 apposite sheave 15 so that each target 34 along the circumference of gearbox sheave 15 passes by that transducer, whereby each target 34** pass-by will elicit a transducer pulse signifying one revolution of the motor rotor. Other motor rotor revolution sensing means can be used. For example, instead of magnetic targets and inductive transducers, the sheave of the motor rotor can have a light passageway (or light block) formed in (on) it parallel to the rotor axis and a light source and a light photodetector can be situated on either side of the sheave so that on pass-by of the light passageway (or block), the photodetector is excited by light sensed through the passageway (or by block interruption of the light) to signal a revolution of the motor rotor. A plurality of light passageways (or light blocks) similarly could be formed in (on) the gearbox sheave for light sensing, as with use of a plurality of magnetic targets, to the same end. Many other ways of generating a signal indicative of a revolution of the motor rotor can be perceived by those of ordinary skill. The foregoing description of magnetic or optic means for signaling the revolution of the motor rotor are merely illustrative. In this it is to be understood that revolution of the power transmission unit rotor is the equivalent to revolution of the motor rotor when the two turn at the same speed or where speed of the motor rotor can be inferred from revolutions of the power transmission unit rotor.

Signal pulses 36*a*, 36*b*, . . . 36*n* generated by tranducer 35 are transmitted by line 37 to a computer 40. Computer 40 suitably comprises (a) an input/output integrated circuit (I/O chip) 41 connected to receive inputs from push button or keyboard input devices 42;(b) and I/O chip 43 connected to receive signal 36 inputs from transducer 35, and also inputs from mode selection switches 44, and further, to output signals both to relays 45 and 46, which respectively are connected to readout device 47 and motor control 48, and to interface 49, for output to an external computer; (c) a quartz clock timer 50; (d) a set/reset counter-divider 51; (e) RAM volatile memory chips 52, 53; (f) EPROM nonvolatile memory chips 54, 55; (g) a central processing chip 56; (h) a power surge and interference reset 57; and (i) a system power supply 58. EPROM's 54, 55 are programmed with software instructions according to which the equations hereinabove described (for one or more parameters of pumping unit performance) may be executed. EPROM's 54, 55 are also programmed with one or more sets of values, according to the particular parameter or parameters to be determined. The value sets which may be employed include one or more value sets ("table lookups") both of the instantaneous performance characteristics $T_i$, $C_i$, and $E_i$ typical for motor 11 at instantaneous $RPM_i$ values for all or a selected range of motor speeds for motor 11, and of the $P_i$, $P_i/E_i$ and $P_i/E_iC_i$ derivatives of one or more of those instantaneous performance characteristics at such instantaneous $RPM_i$ values. Utilization of the derivative "table lookup" value sets saves the step of calculating those derivatives, allowing calculations with less memory storage capacity.

Input/output chip 43 outputs a "high going" pulse 60*a*, 60*b* . . . 60*n* upon receipt of each pulse signal 36*a*, 36*b*, . . . 36*n* from transducer 35. The initial pulse 36*a* signifies the start of a motor rotor 12 revolution and pulse 36*b* signifies the completion of that revolution and the start of a next revolution, and so on; accordingly, the initial high going pulse 60*a* output by I/O chip 43 signifies the start of a motor rotor revolution and the next high going pulse 60*b* signifies the completion of that revolution and the start of the next revolution, and so on. Each pulse from input/output chip 43 is a start/-stop instruction to set/reset counter-divider 51. When counter-divider 51 sees a high going pulse from I/O chip 43, it starts counting pulses of the constant frequency pulse train 51 continuously output by timer 50, and continues this counting until it sees another high going pulse 60*b* from I/O chip 43. The count of pulses made by set/reset counter-divider 51 is a byte or binary expression of data ("$f_i$") from which $RPM_i$ and the time ("$\Delta t_i$") taken to execute one revolution of motor rotor 12 (an "ith revolution") are derived. Upon receipt of a start/stop pulse from chip 43, for example pulse 60*b*, counter-divider 51 outputs a byte data signal and starts another count, and so on. The fact of output of a byte signal by counter-divider 51 is itself indicative of an ith revolution of the prime mover rotor. Thus, the repeating output of counter-divider 51, responsive to pulses indicative of a motor rotor revolution, provides availability of a two dimension matrix ($i=1, 2 \ldots n$; $f_i=f_1, f_2 \ldots f_n$). The bytes output by counter-divider 51 may be passed (line 64, 65) to RAM's 52, 53 and held there in the said two dimensional matrix ($i=1, 2 \ldots n$; $f_i=f_1, f_2 \ldots f_n$) for later calculations directed by CPU 56, or each such byte in RAM (52, 53) may be immediately acted upon by CPU 56 (symbolically designated by line 66), drawing (line 67) on instructions, values and constants programmed in EPROM's (54, 55). The values $C_i$, $T_i$, $E_i$, $P_i$, $E_i/P_i$ and/or $P_i/E_i$ $C_i$ may be matrixed in EPROM's (54, 55) according to $f_i$ or $RPM_i$. In the latter instance, or in instances wherein an $RPM_i$ value is involved in a calculation—for example, in a computation involving $P_i$ as in equations (1), (3) or (5) ($P_i$ not provided as a programmed value) or in a computation involving $PTT_i$, as in equations (6), (7)—CPU 56 draws on a program constant from EPROM (54, 55) to convert $f_i$ to $RPM_i$. For example, the relationship $P_i=\alpha T_i$ ($RPM_i$) in equations (1), (3) and (5) may be expressed as $P_i=\gamma T_i f_i$, where $\gamma=\alpha$ multiplied by a conversion factor of $f_i$ to $RPM_i$. This conversion is 60 (sec./min.) multiplied by the fixed frequency of clock timer 51 (pulses per second) divided by $f_i$ (the number of pulses counted by counter-divider 51 in an ith revolution). The constants and conversion factors are either programmed in EPROM (or set by input push devices 42 to be read by CPU 56).

In computations involving $\Delta t_i$ in equations (6) and (7), CPU 56 similarly draws on a programmed constants (EPROM 54, 55) to convert $f_i$ to $\Delta t_i$. The conversion is $f_i$ divided by the fixed frequency of clock timer 51.

Thus, in a determination of prime mover power input ("PO") for a pumping unit reciprocation cycle or predetermined portion thereof according to equation (1), and using a program in which $P_i$ for $i=1,2 \ldots n$ is calculated immediately from the $f_i$ byte output by counter-divider 51, to obtain PO the calculated $P_i$'s are continuously summed (accumulated) in RAM at the direction of CPU 56 on an accumulate program (in EPROM) until an "end" instruction occurs.

In software, the accumulation to get total $P_i$ ("PT") for $i=1,2 \ldots n$ could look like (i) PT=o (ii) For i=1 to "end"

(iii) $PT=PT+P_1$
(iv) repeat (iii) for next $P_i$
(v) stop at "end"

Depending on the bit capacity of memory in RAM (52, 53) and EPROM (54, 55) and the scope of calculation tasks computer 40 will be asked to perform in a given time, where memory computer is "tight", less than all "$f_i$" bytes carrying $RPM_i$ data or less than all calculated $RPM_i$'s may be applied to obtain the value of the parameter of prime mover or polished rod performance sought to be determined. The selection of $RPM_i$'s (or the equivalent statement, the selection of $f_i$'s) for application is suitably executed by software instruction. Thus, if it is desired to employ only every fifth $RPM_i$ or $f_i$ byte to get a wanted parameter, reverting to the accumulation steps illustrated above, $P_i$ being $\gamma T_i f_i$ as explained hereinabove, between step (ii) and (iii) a subroutine is inserted (ii) (a) if $i \div 5 \neq$ integer, then do no use that $P_i$ in in step (iii), and go to next i.

The "end" instruction may be a value programmed in EPROM (or stored in RAM using input devices 42), such value representing an experience value for motor revolutions typically occurring in the pumping unit reciprocation cycle or predetermined portion thereof of interest, or (in an embodiment not illustrated in the drawings) the "end" instruction may be stored in RAM from a input/output chip 43 input responsive to a signal generated by one or more position sensors situated at a point or points along a pumping unit reciprocating member when the member has reached a predetermined reciprocation position (in this instance the sensors are connected to computer 40 also to correspond the initiation of the count by counter-divider 51 to the commencement of the reciprocation cycle or portion thereof to be monitored).

When the "end" instruction occurs, the summed $P_i$'s are divided in RAM by the value representing "n" revolutions (predetermined programmed value or actual value, from a two-dimensional matrix: $[i=1,2 \ldots n; f_i=f_i, f_2 \ldots f_n]$,, $[i=1,2 \ldots n; P_i=P_1, P_2 \ldots P_n]$, etc.), to get PO.

In EPROM there will be a statement (for example): "if $PO \leqq X$, then output a first (defined) signal"; "if $PO > X \leqq Y$, then output a second (defined) signal"; "if $PO > Y \leqq Z$, then output no signal". To illustrate, Z may be a value indicative of PO when well pump 33 is completely filled with fluid, X may be a value less than Z indicative of mechanical malfunction (such as a parted rod) or pump off, and Y may be a value less than Z but greater than X indicative of less than full pump fillage but not pump-off. Values X, Y and Z are programmed in EPROM (or installed in RAM by means of input devices 42). In accordance with the invention, the comparison called for by the programmed statement is made in RAM at the direction of CPU 56, and unless $PO \geqq Z$, a signal is output calling for corrective action. In the instance of the first (defined) signal, input/output chip 43 is directed to output a signal (line 62) to output relay 46 which by appropriate signal will cause switch off of an energizing circuit (not shown) to motor 11 to stop reciprocation. In the instance of the second (defined) signal, chip 43 will be directed to output a signal to relay 46 which will reduce the speed of motor 11 to better match rate of pump fillage. The foregoing is, of course, merely illustrative.

In application of the method of this invention for pump-off detection and control, it is not necessary to determine the value of a selected parameter of pumping unit performance (for example prime mover power output, prime mover modified average current or a total polished rod work) for the complete reciprocation cycle. As is well known in the art of artificial lift of fluids by reciprocating a beam pumping system, the entire "surface card" trace of polished rod power verses polished rod stroke is not necessary in determining pump-off. Since the right half of the surface card is far most affected by pump-off or pounding, see for example, the drawings in respect of my invention disclosed in U.S. Pat. No. 3,951,209, performing the determination of the selected parameters of pumping unit performance only for that position of the reciprocation cycle represented by the right half of the surface card, preferably the right half of the downstroke portion thereof, can usually detect pump-off.

Figure 4:
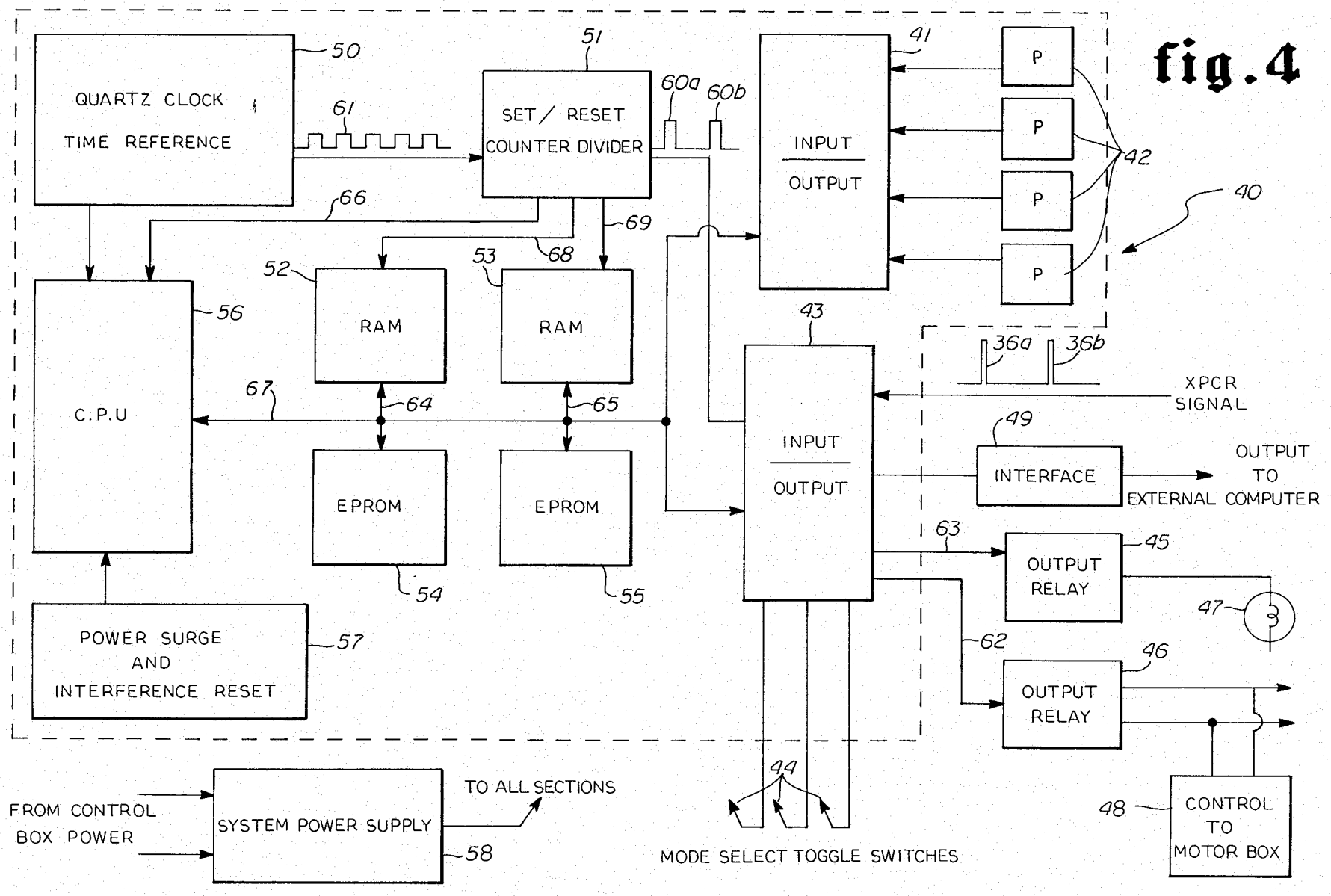
FIG. 4 depicts in block diagram form a digital computing system useful in performing aspects of this invention.

In an aspect of my invention, the predetermined reference parameter (to which a computed value useful for pump off control is compared) is a value for motor output power, motor modified average current or total polished rod work. Establishment of a reference value from a surface card inferred from instantaneous polished rod loads and polish rod displacement in accordance with an aspect of my invention was described hereinabove. The reference parameter also may be established by: shutting the motor off, preferably at selected intervals of time, for a period sufficient to permit the chamber of the subsurface pump to become completely filled with fluid to be pumped; restarting the motor after the expiration of that period of time; and with the pump then filled with fluid, determining the value of motor output power, motor modified average current, or total polished rod work during a reciprocation cycle or portion thereof by application of all or selected $RPM_i$'s, as hereinabove explained; the computed value so determined is then reduced (such as by applying to it a predetermined percentage or by subtraction of a predetermined value from it) to obtain a value which is a selected relationship to the computed value and which from experience is indicative of the selected parameter (total polished rod work motor power output, motor average, modified current) when pump off or mechanical malfunction occurs. So set, the reference value serves as a predetermined "marker" which, when reached by the value for the same parameter computed during regular operation of the pumping unit, triggers shut off of the motor as was explained in reference to FIG. 4. When the reference value is set by a selected relationship for mechanical malfunction, the well will not be restarted. Suitably, the computer will output a reading indicating shutdown of the pumping unit for mechanical malfunction (as at readout device 47). Where the reference value is set for pump off, the pumping unit will be restarted after a prescribed period. This period may be suitably determined by coupling the pump off controller computer 40 to a run time totalizer, or preferably by programming the computer to process timer 50 signals to determine elapsed times (run time and shut down time) and execute a restart signal. The longer the run time before pump off and shutdown, the less the period of shutdown usually need be, and the period of shutdown may be set by the computer as at a selected relationship to the run time preceding the previous shutdown.

A local computer employed for pump off control or to sense mechanical malfunction as hereinabove described may but suitably need not also generate the motor parameters of power input, thermal current and power factor useful for analysis of electrical efficiency of the pumping unit or the power transmission unit maximum torque values useful for determining unit balance or imbalance of the pumping unit. However, by having the computer remember each instantaneous speed of revolution ($RPM_i$ or $f_i$) determined and used in a computation of motor power output, motor modified average current and/or total polished rod work, the remembered instantaneous speeds of revolution suitably may be accessed through interface device 49 and transferred to another computer (which may be portable) plugged into the local logic computer. The parameters not computed by the local computer can then be generated offsite for analysis in accordance with my method, and corrective action taken as indicated. In this application the computer connected to the local logic computer is provided with a set of predetermined values selected from a group of predetermined value sets for motor current and efficiency, or derivatives thereof as has been explained, in which each value in the value set corresponds to a value indicative of the motor speed data accessed from the local computer.

In a unitized producing field, instead of numerous local site computers, suitable advantage may be achieved by utilizing a remote and more powerful computer connected by cable or other telemetry to the motor revolution sensor at each well site. All parameters of motor performance suitably could be generated in this instance.

Applying my invention to determine a worn pump, tubing leaks, well decline or water flood reponse, the computer includes a run time totalizer function and receives signals from a suitable sensor indicative of fluid volume pumped during on/off duty cycles recorded by the run time totalizer function. An increasing trend in the on duty cycle can signify a worn pump or increased productivity brought on by secondary or tertiary recovery methods such as waterflood. By relating increased daily duty cycles to an increase of oil and water production, flood response is indicated. By relating increased daily duty cycles to a decrease of oil and water production, the pump is indicated wearing out or tubing is leaking.

While the method of determining instantaneous motor speed during a complete or a predetermined portion of a reciprocation cycle has been described in reference to a computer determination thereof responsive to a signal indicative of a motor revolution, instantaneous motor speeds can also be determined by other suitable means, such as a generating or digital tachometer and the instantaneous speeds so determined may be applied in a computation of a selected parameter of pumping unit performance.

The preferred means described herein to carry out the operative steps of my method are offered as illustrative examples, and various other implementations than set forth herein may be made without departing from the spirit and scope of the invention as defined by the appended claims.

What is claimed is:

1. A method of monitoring for correction the operation of an oil well pumping unit that includes a prime mover having a rotating rotor and a power transmission unit and which reciprocates a rod string including a polished rod, said string being connected to a subsurface well pump, which comprises:

(a) determining prime mover rotor instantaneous speeds of revolution for revolutions turned during the period of a complete or predetermined portion of a reciprocation cycle of the said pumping unit, (b) applying all or selected instantaneous speeds of revolution from step (a) to determine the value of at least one parameter of pumping unit performance for the said period, said parameter being selected from the group consisting of prime mover power output, prime mover modified average current, prime mover power input, prime mover thermal current, prime mover power factor, power transmission unit maximum torque, and total polished rod work, and (c) comparing the parameter value determined in step (b) to a previously established value for the same selected parameter, to detect whether there exists between such values a relationship predetermined indicative of:

(i) if the selected parameter is one of prime mover power output, prime mover modified average current or total polished rod work: well pump off or a rod string part;

(ii) if the selected parameter is prime mover power input: an excessive prime mover power input;

(iii) if the selected parameter is prime mover thermal current, to detect: an excessive current load for the prime mover;

(iv) if the selected parameter is prime mover power factor: a power factor below an established level;

(v) if the selected parameter is power transmission unit maximum torque: an imbalance in the pumping unit.

2. The method of claim 1 in which said selected performance parameter is power transmission unit maximum performance parameter is power transmission unit maximum torque for one of the unstroke or the downstroke portions of a said reciprocation cycle, and the said previously established value is power transmission unit maximum torque for the other one of the said upstroke or downstroke portions of a reciprocation cycle.

3. A method of monitoring for correction the operation of an oil well pumping unit that includes a prime mover having a rotating rotor and a power transmission unit and which reciprocates a rod string including a polished rod, such string being connected to the plunger of a subsurface well pump, which comprises:

(a) determining the value of at least one parameter of pumping unit performance for the period of a complete or predetermined portion of a reciprocation cycle of the pumping unit, said parameter for such period being a function of instantaneous speeds of revolution of the prime mover rotor during said period, and being selected from the group consisting of prime mover power output, prime mover modified average current, and total polished rod work, (b) comparing the parameter value determined in step (a) to a previously established value for the same selected parameter, to detect whether there exists between such values a relationship predetermined indicative of cause for stopping operation of said pumping unit, and (c) stopping operation of the said pumping unit when said relationship is detected.

4. A method of monitoring for correction the operation of an oil well pumping unit comprising a drive train including a prime mover having a rotor and a power transmission unit having a speed reducer, an energizing circuit for said prime mover, and a reciprocating rod string connected to the plunger of a subsurface well pump, which comprises (a) determining prime mover rotor instantaneous speeds of revolution for revolutions turned during a complete or predetermined portion of a reciprocation cycle of the said pumping unit, (b) applying all or selected instantaneous speeds of revolution from step (a) to obtain the value of at least one parameter or prime mover performance for the period of said cycle or said predetermined portion thereof, as the case may be, said parameter being selected from the parameters consisting of prime mover
power output,
modified average current,
power input,
thermal current, and
power factor,
said parameters being related to said applied instantaneous speeds of revolution according to the following equations, wherein the subscript "i" designates a prime mover rotor revolution occurring during said period with respect to which an instantaneous speed of revolution is applied (an "ith revolution"):

$$(1)\ PO = \frac{1}{n}\sum_{i=1}^{n} P_i$$

wherein

PO = value of prime mover power output for the said period, n = the number of all ith revolutions occurring in the said period, $P_i$ = $\alpha T_i(RPM_i)$ wherein $P_i$ = the instantaneous power output value of the prime mover on an ith revolution of the prime mover rotor, $\alpha$ = predetermined conversion factor constant to obtain proper power units, $RPM_i$ = the value of the instantaneous speed of prime mover rotor revolution on an ith revolution, $T_i$ = the predetermined value of prime mover rotor instantaneous torque that corresponds to $RPM_i$ on an ith revolution of the prime mover rotor, $$(2)\ MAC = \frac{1}{n}\sum_{i=1}^{n} A_i C_i$$

where

MAC = value of prime mover modified average current for the said period, n = the number of all ith revolutions occurring in the said period, $C_i$ = the predetermined value of prime mover instantaneous current that corresponds to $RPM_i$ (as $RPM_i$ is defined for the equation (1) hereof) and an ith revolution of the prime mover rotor, $A_i$ = 1 where $RPM_i$ on an ith revolution is less than or equal to synchronous speed of the prime mover rotor, -continued $A_i$ = −1 where $RPM_i$ on an ith revolutions is greater than synchronous speed of the prime mover rotor;

$$(3)\ PI = \frac{1}{n}\sum_{i=1}^{n} \frac{P_i}{E_i}$$

where

PI = value of prime mover power input for the said period, n = the number of all ith revolutions occurring in the said period, $P_i$ = $\alpha T_i(RPM_i)$, where $P_i$, $\alpha$, $T_i$ and $RPM_i$ are the values defined for equation (1) hereof, and $E_i$ = the predetermined value of prime mover instantaneous efficiency that corresponds to $RPM_i$ on an ith revolution of the prime mover rotor, $$(4)\ TC = \sum_{i=1}^{n} \sqrt{\frac{C_i^2}{n}}$$

where

TC = value of prime mover thermal current for the said period, n = the number of all ith revolutions occurring in the said period, $C_i$ = the value defined for equation (2) hereof, $$(5)\ PF = \frac{v}{n\sqrt{3}\,V}\sum_{i=1}^{n} \frac{P_i}{E_i C_i}$$

where PF is the value of prime mover power factor for the said period, v is a predetermined constant to obtain proper power factor unit, n is the number of all ith revolutions occurring in the said period, $P_i$ is as defined for equation (1), $C_i$ is as defined for equation (2), $E_i$ is as defined for equation (3) and V is value of voltage of the said energizing circuit; and (c) comparing a parameter value obtained in step (b) to a previously established value for the same selected parameter, to detect whether there exists between such values a relationship predetermined indicative of:

(i) if the selected parameter is one of prime mover power output, or prime mover modified average current well pump off or a rod string part;

(ii) if the selected parameter is prime mover power input: an excessive prime mover power input;

(iii) if the selected parameter is prime mover thermal current, to detect: an excessive current load for the prime mover;

(iv) if the selected parameter is prime mover power factor: a power factor below an established level.

5. The method of claim 4 in which the parameter computed in step (b) is prime mover power output or prime mover modified average current, and further comprising (d) shutting off the prime mover to stop operation of said pumping unit when the comparison of step (c) indicates a well pump off or a rod string part.

6. The method of claim 5, in which said previously established value of the said same parameter is established by the steps comprising:

(a) shutting off the prime mover for a period of time sufficient to permit said subsurface well pump to be completely filled with fluid to be pumped;

(b) restarting the prime mover after the expiration of said period of time;

(c) determining the value of prime mover output power or prime mover modified average current according to steps (a) and (b) of claim 4 while the said well pump is completely filled with fluid; and (d) establishing as said previously established value a value which is in selected relationship to the full fillage value for the prime mover output power or, as the case may be, prime mover modified average current, determined in step (c) of this claim.

7. A method of monitoring for correction the operation of an oil well pumping unit comprising a drive train including a prime mover having a rotor and a power transmission unit having a speed reducer, an energizing circuit for said prime mover, and a reciprocating rod string connected to the plunger of a subsurface well pump, which comprises:

(a) determining prime mover rotor instantaneous speeds of revolution for revolutions turned during the period of a complete or predetermined portion of a reciprocation cycle of said pumping unit;

(b) applying all or selected $RPM_i$'s from step (a) and accessing at least one set of predetermined values selected from a group of value sets for prime mover $T_i$, $C_i$, $E_i$, $P_i$, $P_i/E_i$ and $P_i/E_iC_i$, where the subscript "i" denotes a revolution of the prime mover rotor (an "ith revolution") and where $T_i$ means the value of prime mover rotor instantaneous torque that corresponds to $RPM_i$ on an ith revolution, $RPM_i$ means the value of instantaneous speed of prime mover rotor revolution on an ith revolution, $C_i$ means the value of prime mover instantaneous current that corresponds to $RPM_i$ on an ith revolution, $E_i$ means the value of prime mover instantaneous efficiency that corresponds to $RPM_i$ on an ith revolution, and $P_i$ means the value of instantaneous power output of the prime mover on an ith revolution and equals $\alpha T_i$ ($RPM_i$) where $\alpha$ is a predetermined constant to obtain proper units, computing the value of at least one parameter of prime mover performance for the said period, said parameter being selected from the group consisting of prime mover PO, MAC, PI, TC and PF, where (1) PO means prime mover power output for the said period, the value of which is given by the equation $$PO = \frac{1}{n} \sum_{i=1}^{n} P_i$$

in which i and $P_i$ have the meanings stated hereinabove in this claim and "n" means the number of prime mover rotor revolutions with respect to which $RPM_i$'s are applied, (2) MAC means prime mover modified average current for the said period, the value of which is given by the equation $$MAC = \frac{1}{n} \sum_{i=1}^{n} A_iC_i$$

in which i, n and $C_i$ have the meanings stated hereinabove in this claim, $A_i$ is 1 where $RPM_i$ on the ith revolution is less than or equal to synchronous speed of the prime mover rotor, and $A_i$ is $-1$ where $RPM_i$ on the ith revolution is greater than synchronous speed of the prime mover rotor, (3) PI means prime mover power input for the said period, the value of which is given by the equation $$PI = \frac{1}{n} \sum_{i=1}^{n} \frac{P_i}{E_i}$$

in which i, n, $P_i$ and $E_i$ have the meanings stated hereinabove in this claim, (4) TC means prime mover thermal current for the said period, the value of which is given by the equation $$TC = \sum_{i=1}^{n} \sqrt{\frac{C_i^2}{n}}$$

in which i, n and $C_i$ have the meanings stated hereinabove in this claim, (5) PF means prime mover power factor for the said period, the value of which is given by the equation $$PF = \frac{v}{n\sqrt{3}\,V} \sum_{i=1}^{n} \frac{P_i}{E_iC_i}$$

in which i, n, $P_i$, $E_i$ and $C_i$ have the meanings stated hereinabove in this claim, v is a predetermined constant to obtain proper power factor units, and V means voltage of said energizing circuit; and (c) comparing a parameter value computed in step (b) to a previously established value for the same selected parameter, to detect whether there exists between such values a relationship predetermined indicative of:

(i) if the selected parameter is one of prime mover power output, or prime mover modified average current well pump off or a rod string part;

(ii) if the selected parameter is prime mover power input: an excessive prime mover power input;

(iii) if the selected parameter is prime mover thermal current, to detect: an excessive current load for the prime mover;

(iv) if the selected parameter is prime mover power factor: a power factor below an established level.

8. The method of claim 7 in which the parameter computed in step (b) is prime mover PO or MAC, and further comprising:

(d) shutting off the prime mover to stop reciprocation of said pumping unit when this step (c) comparison indicates a well pump off or a rod string part.

9. The method of claim 8 in which the said previously established same parameter is established by the steps comprising:

(a) shutting off prime mover for a period of time sufficient to permit said subsurface well pump to be completely filled with fluid to be pumped;

(b) restarting the prime mover after the expiration of said period of time;

(c) determining prime mover PO or prime mover MAC according to steps (a) and (b) of claim 7 while the said well pump is completely filled with fluid; and (d) establishing as said previously established value a value which is in selected relationship to the full fillage value of the prime mover PO or prime mover MAC, as the case may be, determined in step (c) of this claim.

10. The method of claim 8 or 4 further comprising:

(e) remembering a predetermined minimum quantity of the $RPM_i$ values determined in step (a), (f) accessing said remembered $RPM_i$ values, and (g) applying said accessed $RPM_i$'s, performing step (b) for one or more of prime mover PI, TC and PF.

11. A method of monitoring for operational correction an oil well pumping unit which comprises a surface drive train including a prime mover having a rotor and a power transmission unit having a speed reducer and a counterbalance, surface structure for changing rotating motion of the prime mover and power transmission unit into reciprocating motion, a subsurface reciprocating well pump, and a rod string for transmitting the surface reciprocation motion and power to the subsurface well pump, comprising the steps of:

(a) determining the time for and the instantaneous speed of each prime mover revolution occurring during a downstroke of a reciprocation cycle of the said pumping unit;

(b) determining the time for and the instantaneous speed of each prime mover rotor revolution occurring during an upstroke of a reciprocation cycle of the said pumping unit;

(c) applying all times for and instantaneous speeds of revolution determined in steps (a) and (b), computing the power transmission unit torque for each prime mover rotor revolution (an "ith revolution"), according to the equation $$PTT_i = nT_i - \frac{kI}{\Delta t_i}(RPM_i - RPM_{i-1})$$

in which

| | | |
|---|---|---|
| $PTT_i$ | = | the value of power transmission unit torque during an ith revolution of the prime mover rotor, |
| $RPM_i$ | = | the value of the instantaneous speed of prime mover rotor revolution on an ith revolution, |
| $RPM_{i-1}$ | = | the value of the instantaneous speed of prime mover rotor revolution on the prime mover rotor revolution next preceding an ith revolution, |
| $\Delta t_i$ | = | the time required to execute an ith revolution, |
| $T_i$ | = | the predetermined value of prime mover rotor instantaneous torque that corresponds to $RPM_i$ on an ith revolution, |
| k | = | conversion factor constant to obtain proper torque units, |
| I | = | moment of inertia constant of the said drive train starting at the said prime mover rotor and ending at the said speed reducer of the power transmission unit, |

-continued $$PTT_i = nT_i - \frac{kI}{\Delta t_i}(RPM_i - RPM_{i-1})$$

in which for i=1,2 . . . n revolutions of the prime mover rotor during the said upstroke and for i=1,2 . . . n revolutions of the prime mover rotor occurring during the said downstroke, where n signifies number of prime mover rotor revolutions in respectively said upstroke and said downstroke;

(d) determining the maximum $PTT_i$ value computed in step (c) for prime mover rotor revolutions occurring during the said upstroke (the "upstroke PTTmax") and determining the maximum $PTT_i$ value computed in step (c) for prime mover rotor revolutions occurring during the said downstroke (the "downstroke PTTmax");

(e) comparing said upstroke PTTmax and said downstroke PTTmax to detect whether said upstroke PTTmax and said downstroke PTTmax are unequal; and (f) if upstroke PTTmax exceeds downstroke PTTmax in the step (e) comparison, increasing said counterbalance;

(g) if downstroke PTTmax exceeds upstroke PTTmax in the step (e) comparison, decreasing said counterbalance.

12. A method of determining instantaneous polished rod loads for use in monitoring, for operational correction, an oil well pumping unit which comprises a surface drive train including a prime mover having a rotor and a power transmission unit having a speed reducer, a crankshaft and a counterbalance; surface structure for changing rotating motion of the prime mover and power transmission unit into reciprocating motion, a subsurface reciprocating well pump, and a rod string including a surface polished rod for transmitting the surface reciprocating motion and power to the subsurface well pump, comprising the steps of (a) determining the time for and instantaneous speed of each prime mover rotor rotation occurring during the period of a complete or predetermined portion of a reciprocation of the said pumping unit, (b) determining the instantaneous position displacement of said polished rod corresponding to selected revolutions of the prime mover rotor occurring during said period, and (c) applying all times for and instantaneous speeds of revolution determined in step (a), computing the instantaneous polished rod load during each prime mover rotor revolution (an "ith revolution") occurring during said period, according to the equation $$PRL_i = \frac{nT_i + m\sin(\theta_i + \beta) - RIT + AIT}{TF_i} + S$$

where

| | | |
|---|---|---|
| $PRL_i$ | = | value of instantaneous polished rod load on an ith revolution of the prime mover rotor, |
| n | = | the number of all ith revolutions occurring in the said period |
| $T_i$ | = | the predetermined value of the instantaneous motor torque that |

-continued $$PRL_i = \frac{{}_nT_i + m \sin(\theta_i + \beta) - RIT + AIT}{TF_i} + S$$

where

| | | |
|---|---|---|
| | | corresponds to $RPM_i$ on ith revolution |
| m | = | predetermined value for counterbalance effect |
| $\Theta_i$ | = | angle of pumping unit crankshaft corresponding to the ith revolution of the prime mover rotor |
| $\beta$ | = | predetermined phase angle for counterbalance |
| $TF_i$ | = | predetermined value of instantaneous torque factor that corresponds to the ith revolution of the prime mover rotor |
| $RIT_i$ | = | rotary inertia torque affect on prime mover rotor during its ith revolution as given by |

$$RIT_i = \frac{I_r(RPM_i - RPM_{i-1})}{\Delta t_i}$$

where

| | | |
|---|---|---|
| $I_r$ | = | predetermined moment of inertia of rotary elements in said drive train |
| $RPM_i$ | = | the value of the instantaneous speed of prime mover rotor revolution on an ith revolution, |
| $RPM_{i-1}$ | = | the value of the instantaneous speed of prime mover rotor revolution on the prime mover revolution next preceding an ith revolution, |
| $\Delta t_i$ | = | the time required to execute an ith revolution |
| $AIT_i$ | = | articulating inertia affect on motor during its ith revolution as given by |

$$AIT_i = \frac{TF_i I_a}{A^2} \quad \frac{PRP_{i+1} - 2PRP_i + PRP_{i-1}}{\Delta t_i^2}$$

where

| | | |
|---|---|---|
| $TF_i$ | = | as defined hereinabove in this claim |
| $I_a$ | = | moment of inertia of said surface structure for changing rotating motion into reciprocating motion |
| n | = | as defined hereinabove in this claim |
| A | = | predetermined dimension of pumping unit |
| $\Delta t_i$ | = | as defined hereinabove in this claim |
| $PRP_i$ | = | position of said polished rod corresponding to ith revolution of prime mover rotor |
| $PRP_{i+1}$ | = | position of polished rod corresponding to revolution of the prime mover rotor immediately following the ith revolution. |
| $PRP_{i-1}$ | = | position of polished rod corresponding to revolution of the prime mover rotor immediately preceding the ith revolution, and |
| S | = | predetermined constant for structural imbalance of the pumping unit. |

13. The method of claim 12 further comprising relating instantaneous polish rod loads determined in step (c) to instantaneous polished rod position displacements determined in step (b) to obtain a plot of one of them against the other.

14. The method of claim 13 further comprising determining from said plot a value indicative of cause for stopping operation of said pumping unit.

15. The method of claim 13 further comprising integrating instantaneous polished rod load verses polished rod position displacement to obtain a value for total polished rod work for the said period.

16. The method of claim 15 further comprising: comparing the said value for total polished rod work to a previously established value for total polished rod work, to detect whether there exists between such values a relationship indicative of cause for stopping operation of said pumping unit, and stopping operation of the pumping unit when said relationship is detected.

17. The method of claim 16 in which said predetermined value is either the value of total polished rod work when the said well pump is completely filled with fluid, or a value relative to said full fillage value and which is indicative of pump-off.

18. The method of claim 16 in which said predetermined value is established by the method of claim 14.

19. The method of claim 13, 14, 15, 16 or 18 in which $RIT_i$ and $AIT_i$ are negligible.

20. A method of determining instantaneous polished rod loads for use in monitoring, for operational correction, an oil well pumping unit which comprises a surface drive train including a prime mover havng a rotor and a power transmission unit having a speed reducer, and a cylinder and piston air pressure counterbalance; surface structure including a walking beam for changing rotating motion of the prime mover and power transmission unit into reciprocating motion, a subsurface reciprocating well pump, and a rod string including a surface polished rod for transmitting the surface reciprocating motion and power to the subsurface well pump, comprising the steps of (a) determining the time for and instantaneous speed of each prime mover rotor rotation occurring during the period, of a complete or predetermined portion of a reciprocation of said pumping unit, (b) determining the instantaneous position displacement of said polished rod corresponding to selected revolutions of the prime mover rotor occurring during the said period, and (c) applying all or selected times for and instantaneous speeds of revolution determined in step (a), computing the instantaneous polished rod load during each prime mover rotor revolution (an "ith revolution") occurring during said period, according to the equation $$(8)\ PRL_i = \frac{nT_i + RIT_i - AIT_i}{TF_i} + M(PR_i - S)$$

where

| | | |
|---|---|---|
| $PRL_i$ | = | value of instantaneous polished rod load on an ith revolution of the prime mover rotor, |
| n | = | the number of all ith revolutions occurring in the said period |
| $T_i$ | = | the predetermined value of the instantaneous motor torque that corresponds to $RPM_i$ on ith revolution |
| $TF_i$ | = | predetermined value of instantaneous torque factor that corresponds to the ith revolution of the prime mover rotor |
| S | = | air pressure required to offset pumping unit structural unbalance |
| M | = | predetermined constant relating area of said piston to dimensions of said walking beam |
| $PR_i$ | = | counterbalancing air pressure corresponding to the ith revolution of the prime mover rotor |
| $RIT_i$ | = | rotary inertia torque affect on prime mover rotor during its ith revolution as given by |

-continued $$RIT_i \frac{I_r(RPM_i - RPM_{i-1})}{\Delta t_i}$$

where

| | | |
|---|---|---|
| $I_r$ | = | predetermined moment of inertia of rotary elements in said drive train |
| $RPM_i$ | = | the value of the instantaneous speed of prime mover rotor revolution on an ith revolution, |
| $RPM_{i-1}$ | = | the value of the instantaneous speed of prime mover rotor revolution on the prime mover revolution next preceding an ith revolution, |
| $\Delta t_i$ | = | the time required to execute an ith revolution |
| $AIT_i$ | = | articulating inertia affect on motor during its ith revolution as given by |

$$AIT_i = \frac{TF_i Ia}{A^2}\left[\frac{PRP_{i+1} - 2\,PRP_i + PRP_{i-1}}{\Delta t_i^2}\right]$$

where

| | | |
|---|---|---|
| $TF_i$ | = | as defined hereinabove in this claim |
| $I_a$ | = | moment of inertia of said surface structure for changing rotating motion into reciprocating motion |
| n | = | as defined hereinabove in this claim |
| A | = | predetermined dimension of pumping unit |
| $\Delta t_i$ | = | as defined hereinabove in this claim |
| $PRP_i$ | = | position of said polished rod corresponding to ith revolution of prime mover rotor |
| $PRP_{i+1}$ | = | position of polished rod corresponding to revolution of the prime mover rotor immediately following the ith revolution |
| $PRP_{1-1}$ | = | position of polished rod corresponding to revolution of the prime mover rotor immediately preceding the ith revolution. |

21. The method of claim 20 further comprising relating instantaneous polish rod loads determined in step (c) to instantaneous polished rod position displacements determined in step (b) to obtain a plot of one of them against the other.

22. The method of claim 21 further comprising determining from said plot a value indicative of cause for stopping operation of said pumping unit.

23. The method of claim 21 further comprising integrating instantaneous polished rod load verses instantaneous polished rod position displacement to obtain a value for total polished rod work for the said period.

24. The method of claim 21 further comprising comparing the said value for total polished rod work to a previously established value for total polished rod work, to detect whether there exists between such values a relationship indicative of cause for stopping operation of said pumping unit, and stopping operation of the pumping unit when said relationship is detected.

25. A method of monitoring for correction the operation of an oil well pumping unit that includes a prime mover having a rotating rotor and a power transmission unit and which reciprocates a rod string including a polished rod, said string being connected to a subsurface well pump, which comprises:

(a) determining prime mover rotor instantaneous speeds of revolution for revolutions turned during the period of a complete or predetermined portion of a reciprocation cycle of the said pumping unit, (b) applying all or selected instantaneous speeds of revolution from step (a) to determine the value of at least one parameter of pumping unit performance for the said period selected from the group consisting of prime mover power output, prime mover modified average current, and total polished rod work, (c) comparing the parameter value determined in step (b) to a previously established value for the same selected parameter, to detect whether there exists between such values a relationship indicative of cause for stopping operation of the said pumping unit, and (d) stopping operation of said pumping unit when said relationship is detected.

26. The method of claim 25 further comprising (e) remembering a predetermined minimum quantity of the instantaneous speeds of revolution determined in step (a), (f) accessing said remembered speeds, (g) applying said accessed speeds to determine the value of at least one parameter of pumping unit performance consisting of prime mover power input, prime mover thermal current and prime mover power factor, and (h) comparing the parameter value determined in step (g) to a standard established for such parameter.

27. A control system for an oil well beam pumping unit powered by a prime mover having a rotor and which reciprocates a rod string connected to a subsurface well pump, said system comprising:

(a) sensor means for sensing complete revolutions of said rotor and generating a signal indicative of each such revolution;

(b) expressor means, communicative with said sensor means and responsive to each said signal, for producing an expression of the instantaneous speed of each such revolution;

(c) memory means, communicative with said expressor means, for remembering values, each corresponding to a specific instantaneous speed of revolution value, in a set of values indicative of a selected parameter of prime mover performance;

(d) computative means, communicative with said memory means and said expressor means, responsive to all or selected said expressions of instantaneous speeds of revolution sensed during a complete or predetermined portion of a reciprocation cycle of said pumping unit, for accessing said remembered parameter values and for determining the average of all such accessed parameter values during said period;

(e) comparator means, communicative with said computative means, for comparing said average of said accessed parameter values to a value previously established for the same parameter and for outputting an error signal when said comparison detects a predetermined relationship between such compared values indicative of well pump off or rod string part, and (f) means, communicative with said comparator means and responsive to said error signal, for outputting an execute signal for de-energizing said prime mover to stop pumping unit reciprocation.

28. The system of claim 27 in which said memory means includes means for volatilely remembering said expressions of instantaneous speeds of revolution.

29. The system of claim 28 further comprising separate accessor means for accessing said volatile memory means and transferring the remembered speed values therein to separate computational means for computation of selected parameters of pumping unit performance.

* * * * *